US009786288B2

(12) United States Patent
Hu et al.

(10) Patent No.: US 9,786,288 B2
(45) Date of Patent: Oct. 10, 2017

(54) AUDIO OBJECT EXTRACTION

(71) Applicant: DOLBY LABORATORIES LICENSING CORPORATION, San Francisco, CA (US)

(72) Inventors: Mingqing Hu, Beijing (CN); Lie Lu, Beijing (CN); Jun Wang, Beijing (CN)

(73) Assignee: Dolby Laboratories Licensing Corporation, San Franscisco, CA (US)

( * ) Notice: Subject to any disclaimer, the term of this patent is extended or adjusted under 35 U.S.C. 154(b) by 0 days.

(21) Appl. No.: 15/031,887

(22) PCT Filed: Nov. 25, 2014

(86) PCT No.: PCT/US2014/067318

§ 371 (c)(1),
(2) Date: Apr. 25, 2016

(87) PCT Pub. No.: WO2015/081070

PCT Pub. Date: Jun. 4, 2015

(65) Prior Publication Data

US 2016/0267914 A1 Sep. 15, 2016

Related U.S. Application Data

(60) Provisional application No. 61/914,129, filed on Dec. 10, 2013.

(30) Foreign Application Priority Data

Nov. 29, 2013 (CN) ..... 2013 1 0629972

(51) Int. Cl.
*H04R 3/04* (2006.01)
*G10L 19/12* (2013.01)
(Continued)

(52) U.S. Cl.
CPC ..... *G10L 19/02* (2013.01); *G10L 19/008* (2013.01); *G10L 19/038* (2013.01); *H04S 3/008* (2013.01); *H04S 2400/11* (2013.01)

(58) Field of Classification Search
CPC .... G10L 19/008; G10L 21/0232; G10L 25/69
(Continued)

(56) References Cited

U.S. PATENT DOCUMENTS 6,498,857 B1 12/2002 Sibbald
7,035,418 B1 4/2006 Okuno
(Continued)

FOREIGN PATENT DOCUMENTS

WO 2013/028351 2/2013
WO 2013/080210 6/2013

OTHER PUBLICATIONS

Briand, M. et al "Parametric Representation of Multichannel Audio Based on Principal Component Analysis", AES presented at the 120th Convention, May 20-23, 2006, Paris, France, pp. 1-14.
(Continued)

*Primary Examiner* — George Monikang

(57) ABSTRACT

Embodiments of the present invention relate to audio object extraction. A method for audio object extraction from audio content of a format based on a plurality of channels is disclosed. The method comprises applying audio object extraction on individual frames of the audio content at least partially based on frequency spectral similarities among the plurality of channels. The method further comprises performing audio object composition across the frames of the audio content, based on the audio object extraction on the individual frames, to generate a track of at least one audio object. Corresponding system and computer program product are also disclosed.

23 Claims, 5 Drawing Sheets

(51) Int. Cl.

| | |
|---|---|
| ***G10L 19/02*** | (2013.01) |
| ***G10L 19/008*** | (2013.01) |
| ***G10L 19/038*** | (2013.01) |
| ***H04S 3/00*** | (2006.01) |

(58) Field of Classification Search
USPC ..... 381/10, 98; 704/220
See application file for complete search history.

(56) References Cited

U.S. PATENT DOCUMENTS

| | | | |
|---|---|---|---|
| 7,394,908 | B2 | 7/2008 | Katou |
| 7,912,566 | B2 | 3/2011 | Lee |
| 8,027,478 | B2 | 9/2011 | Barry |
| 8,068,105 | B1 | 11/2011 | Classen |
| 8,140,331 | B2 | 3/2012 | Lou |
| 8,213,633 | B2 | 7/2012 | Kobayashi |
| 8,422,694 | B2 | 4/2013 | Morito |
| 8,423,064 | B2 | 4/2013 | Kleijn |
| 8,520,873 | B2 | 8/2013 | Mahabub |
| 2005/0286725 | A1 | 12/2005 | Yamada |
| 2006/0064299 | A1 | 3/2006 | Uhle |
| 2007/0071413 | A1 | 3/2007 | Takahashi |
| 2010/0232619 | A1 | 9/2010 | Uhle |
| 2010/0329466 | A1 | 12/2010 | Berge |
| 2011/0046759 | A1 | 2/2011 | Kim |
| 2011/0081024 | A1 | 4/2011 | Soulodre |
| 2011/0274278 | A1 | 11/2011 | Kim |
| 2012/0046771 | A1 | 2/2012 | Abe |
| 2012/0143363 | A1 | 6/2012 | Liu |
| 2012/0183162 | A1 | 7/2012 | Chabanne |
| 2012/0213375 | A1 | 8/2012 | Mahabub |
| 2012/0278326 | A1 | 11/2012 | Bauer |
| 2013/0046399 | A1 | 2/2013 | Lu |
| 2013/0046536 | A1 | 2/2013 | Lu |
| 2013/0058488 | A1 | 3/2013 | Cheng |
| 2013/0064379 | A1 | 3/2013 | Pardo |
| 2013/0110521 | A1 | 5/2013 | Hwang |
| 2013/0121495 | A1 | 5/2013 | Mysore |
| 2013/0132210 | A1 | 5/2013 | Kim |
| 2013/0142341 | A1 | 6/2013 | Del Galdo |

OTHER PUBLICATIONS

Bishop, Christopher M "Pattern Recognition and Machine Learning" Springer, pp. 136-152, 2007.

Comon, P. et al "Handbook of Blind Source Separation: Independent Component Analysis and Applications" Academic Press, 2010.

Spanias, A. et al "Audio Signal Processing and Coding" Wiley-Interscience, John Wiley & Sons, 2006, pp. 1-6.

Zolzer, Udo, "Digital Audio Signal Processing" John Wiley & Sons, 1997.

Schnitzer, D. et al "A Fast Audio Similarity Retrieval Method for Millions of Music Tracks" Journal Multimedia Tools and Applications, vol. 58, Issue 1, pp. 23-40, May 2012.

Vincent, E. et al "Performance Measurement in Blind Audio Source Separation" IEEE Transactions on Audio, Speech, and Language Processing, vol. 14, No. 4, pp. 1462-1469, Jul. 2006.

Parry, Robert Mitchell, "Separation and Analysis of Multichannel Signals" A Thesis presented to the Academic Faculty, Dec. 2007.

Cho, Namgook "Source-Specific Learning and Binaural Cues Selection Techniques for Audio Source Separation" University of Southern California dissertations and theses, Dec. 2009.

Zhang, X. et al "Sound Isolation by Harmonic Peak Partition for Music Instrument Recognition" Dec. 2007, Fundamental Informaticae—Special Issue 4, vol. 78, pp. 613-628.

Duraiswami, R. et al "High Order Spatial Audio Capture and its Binaural Head-Tracked Playback Over Headphones with HRTF Cues" AES 119th Convention, Oct. 1, 2005.

Nakatani, T. et al "Localization by Harmonic Structure and its Application to Harmonic Sound Stream Segregation" IEEE International conference on Acoustics, Speech, and Signal Processing, May 7-10, 1996, pp. 653-656, vol. 2.

Moon, H. et al "Virtual Source Location Information Based Matrix Decoding System" AES 120th Convention, Paris, France, May 20-23, 2006, pp. 1-5.

Suzuki, S. et al "Audio Object Individual Operation and its Application to Earphone Leakage Noise Reduction" Proc. of the 4th International Symposium on Communications, Control and Signal Processing, Limassol, Cyprus, Mar. 3-5, 2010.

http://www.dolby.com/us/en/consumer/technology/movie/dolby-atmos.html.

AUDIO OBJECT EXTRACTION

CROSS REFERENCE TO RELATED APPLICATIONS

This application claims priority to Chinese Patent Application No. 201310629972.2, filed 29 Nov. 2013 and U.S. Provisional Patent Application No. 61/914,129, filed on 10 Dec. 2013, each of which is hereby incorporated by reference in its entirety.

TECHNOLOGY

Embodiments of the present invention generally relate to audio content processing, and more specifically, to method and system for audio object extraction.

BACKGROUND

Traditionally, audio content is created and stored in channel-based formats. As used herein, the term "audio channel" or "channel" refers to the audio content that usually has a predefined physical location. For example, stereo, surround 5.1, 7.1 and the like are all channel-based formats for audio content. Recently, with developments in the multimedia industry, three-dimensional (3D) movies and television content are getting more and more popular in cinema and home. In order to create a more immersive sound field and to control discrete audio elements accurately, irrespective of specific playback speaker configurations, many conventional multichannel systems have been extended to support a new format that includes both channels and audio objects.

As used herein, the term "audio object" refers to an individual audio element that exists for a defined duration in time in the sound field. An audio object may be dynamic or static. For example, audio objects may be humans, animals or any other elements serving as sound sources. During transmission, audio objects and channels can be sent separately, and then used by a reproduction system on the fly to recreate the artistic intents adaptively based on the configuration of playback speakers. As an example, in a format known as "adaptive audio content," there may be one or more audio objects and one or more "channel beds" which are channels to be reproduced in predefined, fixed locations.

In general, object-based audio content is generated in a quite different way from the traditional channel-based audio content. Due to constraints in terms of physical devices and/or technical conditions, however, not all audio content providers are capable of generating the adaptive audio content. Moreover, although the new object-based format allows creation of more immersive sound field with the aid of audio objects, the channel-based audio format still prevails in movie sound ecosystem, for example, in the chains of sound creation, distribution and consumption. As a result, given traditional channel-based content, in order to provide end users with similar immersive experiences as provided by the audio objects, there is a need to extract audio objects from traditional channel-based content. At present, however, no solution is known to be capable of accurately and efficiently extracting audio objects from conventional channel-based audio content.

In view of the foregoing, there is a need in the art for a solution for audio object extraction from channel-based audio content.

SUMMARY

In order to address the foregoing and other potential problems, the present invention proposes a method and system for extracting audio objects from channel-based audio content.

In one aspect, embodiments of the present invention provide a method for audio object extraction from audio content, the audio content being of a format based on a plurality of channels. The method comprises applying audio object extraction on individual frames of the audio content at least partially based on frequency spectral similarities among the plurality of channels and performing audio object composition across the frames of the audio content, based on the audio object extraction on the individual frames, to generate a track of at least one audio object. Embodiments in this regard further comprise a corresponding computer program product.

In another aspect, embodiments of the present invention provide a system for audio object extraction from audio content, the audio content being of a format based on a plurality of channels. The system comprising: a frame-level audio object extracting unit configured to apply audio object extraction on individual frames of the audio content at least partially based on frequency spectral similarities among the plurality of channels and an audio object composing unit configured to perform audio object composition across the frames of the audio content, based on the audio object extraction on the individual frames, to generate a track of at least one audio object.

Through the following description, it would be appreciated that in accordance with embodiments of the present invention, the audio objects can be extracted from the traditional channel-based audio content in two stages. First, the frame-level audio object extraction is performed to group the channels, such that the channels within a group are expected to contain at least one common audio object. Then the audio objects are composed across multiple frames to obtain complete tracks of the audio objects. In this way, audio objects, no matter stationary or in motion may be accurately extracted from the traditional channel-based audio content. Other advantages achieved by embodiments of the present invention will become apparent through the following descriptions.

DESCRIPTION OF DRAWINGS

Through the following detailed description with reference to the accompanying drawings, the above and other objectives, features and advantages of embodiments of the present invention will become more comprehensible. In the drawings, several embodiments of the present invention will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
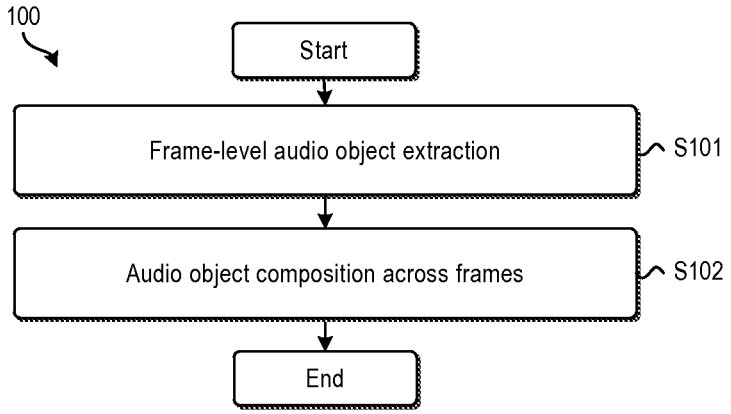
FIG. 1 illustrates a flowchart of a method for audio object extraction in accordance with an example embodiment of the present invention.

Principles of the present invention will now be described with reference to various example embodiments illustrated in the drawings. It should be appreciated that depiction of these embodiments is only to enable those skilled in the art to better understand and further implement the present invention, not intended for limiting the scope of the present invention in any manner.

As mentioned above, it is desired to extract audio objects from audio content of traditional channel-based formats. To this end, some problems have to be addressed, including but not limited to:

- An audio object could either be stationary or moving. For a stationary audio object, although its position is fixed, it could appear in any position in the sound field. For a moving audio object, it is difficult to predict its arbitrary trajectory simply based on predefined rules.
- Audio objects may coexist. A plurality of audio objects could either appear with few overlaps within channels, or heavily overlapped (or mixed) in several channels. It is difficult to blindly detect whether overlaps occur in some channels. Moreover, separating such overlapped audio objects into multiple clean ones is challenging.
- For the traditional channel-based audio content, a mixer usually activates some neighboring or non-neighboring channels of a point-source audio object in order to enhance the perception of its size. The activation of non-neighboring channels makes the estimation of a trajectory difficult.
- Audio objects could have a high dynamic range of duration, for example, spanning from thirty milliseconds to ten seconds. In particular, for an object with a long duration, both its frequency spectrum and size usually vary over time. It is difficult to find a set of robust cues to generate complete or continuous audio objects.

In order to address the above and other potential problems, embodiments of the present invention proposes a method and system for two-stage audio object extraction. The audio object extraction is first performed on individual frames, such that the channels are grouped or clustered at least partially based on their similarities with each other in terms of frequency spectra. As such, the channels within a group are expected to contain at least one common audio object. Then the audio objects may be composed across the frames to obtain complete tracks of the audio objects. In this way, audio objects, no matter stationary or in motion may be accurately extracted from the traditional channel-based audio content. In some example embodiments, by means of post-processing like sound source separation, it is possible to further improve the quality of the extracted audio object. Additionally or alternatively, spectrum synthesis may be applied to obtain audio tracks in desired formats. Moreover, additional information such as positions of the audio objects over time may be estimated by trajectory generation.

Reference is first made to FIG. 1 which shows a flowchart of a method 100 for audio object extraction from audio content in accordance with example embodiments of the present invention. The input audio content is of a format based on a plurality of channels. For example, the input audio content may conform to stereo, surround 5.1, surround 7.1, or the like. In some embodiments, the audio content may be represented as frequency domain signal. Alternatively, the audio content may be input as time domain signal. In those embodiments where the time domain audio signal is input, it may be necessary to perform some preprocessing to obtain corresponding frequency signal and associated coefficient or parameters, for example. Example embodiments in this regard will be discussed below with reference to FIG. 2.

At step S101, audio object extraction is applied on individual frames of the input audio content. In accordance with embodiments of the present invention, such frame-level audio object extraction may be performed at least partially based on the similarities among the channels. As known, in order to enhance spatial perception, audio objects are usually rendered into different spatial positions by mixers. As a result, in traditional channel-based audio contents, spatially-different audio objects are usually panned into different sets of channels. Accordingly, the frame-level audio object extraction at step S101 is used to find a set of channel groups, each of which contains the same audio object(s), from the spectrum of each frame.

For example, in the embodiments where the input audio content is of a surround 5.1 format, there may be a channel configuration of six channels, namely, left (L), right (R), central (C), low frequency energy (Lfe), left surround (Ls) and right surround (Rs) channels. Among these channels, if two or more channels are similar to one another in terms of frequency spectra, then it is reasonable to identify that at least one common audio object is contained in these channels. In this way, a channel group containing similar channels may be used to represent at least one audio object. Still considering the above example embodiments, for a surround 5.1 audio content, the channel group resulted from the frame-level audio object extraction may be any non-empty set of the channels, such as {L}, {L, Rs}, and the like, each of which represents a respective audio object(s).

It is observed that if an audio object appears in a channel group, the temporal-spectral tiles in the corresponding channels show high similarity when compared to those of the remaining channels. Therefore, in accordance with embodiments of the present invention, the frame-level grouping of channels may be done at least partially based on the frequency spectral similarities of the channels. Frequency spectral similarity between two channels may be determined in various manners, which will be detailed later. Further, in addition to or instead of the frequency spectral similarity, frame-level extraction of audio objects may be performed according to other metrics. In other words, the channels may be grouped according to alternative or additional characteristics such as loudness, energy, and so forth. Cues or information provided by a human user may also be used. The scope of the present invention is not limited in this regard.

The method 100 then proceeds to step S102, where audio object composition is performed across the frames of the audio content based on outcome of the frame-level audio object extraction at step S101. As a result, tracks of one or more audio objects may be obtained.

It would be appreciated that after performing the frame-level audio object extraction at step S101, those stationary audio objects might be well described by the channel groups. However, audio objects in the real world are often in motion. In other words, an audio object may move from one channel group to another over time. In order to compose a complete audio object, at step S102, the audio objects are composed across multiple frames with respect to all of the possible channels groups, thereby achieving audio object composition. For example, if it is found the channel group {L} in the current frame is very similar to the channel group {L, Rs} in the previous frame, it may indicate that an audio object move from the channel group {L, Rs} to {L}.

In accordance with embodiments of the present invention, audio object composition may be performed according to a variety of criteria. For example, in some embodiments, if an audio object exists in a channel group for several frames, then information of these frames may be used to compose that audio object. Additionally or alternatively, the number of channels that are shared among the channel groups may be used in audio object composition. For example, when an audio object is moving out of a channel group, the channel group in the next frame with maximum number of shared channels with the previous channel group may be selected as an optimal candidate. Furthermore, similarity of frequency spectral shape, energy, loudness and/or any other suitable metrics among the channel groups may be measured across the frames for audio object extraction. In some embodiments, it is also possible to take into account whether a channel group has been associated with another audio object. Example embodiments in this regard will be further discussed below.

With the method 100, both stationary and moving audio objects may be accurately extracted from the channel-based audio content. In accordance with embodiments of the present invention, the track of an extracted audio object may be represented as multichannel frequency spectra, for example. Optionally, in some embodiments, source separation may be applied to analyze outputs of the spatial audio object extraction to separate different audio objects, for example, using statistical analysis like principle component analysis (PCA), independent component analysis (ICA), canonical correlation analysis (CCA), or the like. In some embodiments, frequency spectrum synthesis may be performed on the multichannel signal in the frequency domain to generate multichannel audio tracks in a waveform format. Alternatively, the multichannel track of an audio object may be down-mixed to generate a stereo/mono audio track with energy preservation. Furthermore, in some embodiments, for each of the extracted audio objects, trajectory may be generated to describe the spatial positions of the audio object to reflect the original intention of original channel-based audio content. Such post-processing of the extracted audio objects will be described below with reference to FIG. 6.

Figure 2:
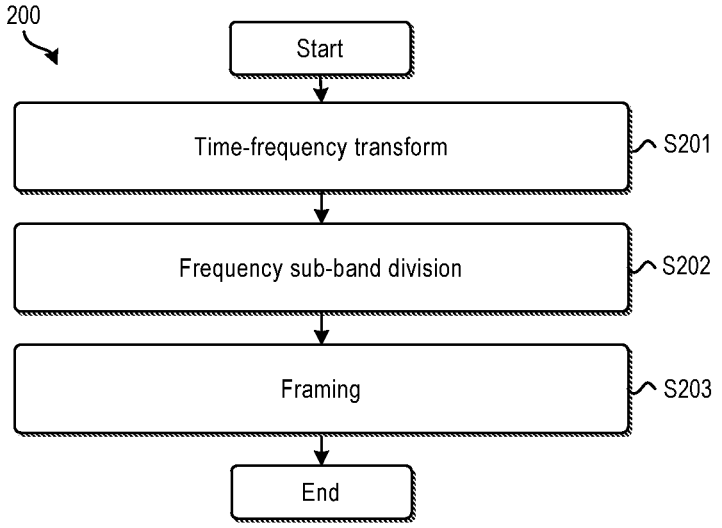
FIG. 2 illustrates a flowchart of a method for preprocessing the time domain audio content of a channel-based format in accordance with an example embodiment of the present invention.

FIG. 2 shows a flowchart of a method 200 for preprocessing the time domain audio content of a channel-based format. As described above, embodiments of the method 200 may be implemented when the input audio content is of a time domain representation. Generally speaking, with the method 200, the input multichannel signal may be divided into a plurality of blocks, each of which contains a plurality of samples. Then each block may be converted into a frequency spectral representation. In accordance with embodiments of the present invention, a predefined number of blocks are further combined as a frame, and the duration of a frame may be determined depending on the minimum duration of the audio object to be extracted.

As shown in FIG. 2, at step S201, the input multichannel audio content is divided into a plurality of blocks using a time-frequency transform such as conjugated quadrature mirror filterbanks (CQMF), Fast Fourier Transform (FFT), or the like. In accordance with embodiments of the present invention, each block typically comprises a plurality of samples (e.g., 64 samples for CQMF, or 512 samples for FFT).

Next, at step S202, the full frequency range may be optionally divided into a plurality of frequency sub-bands, each of which occupies a predefined frequency range. The division of the whole frequency band into multiple frequency sub-bands is based on the observation that when different audio objects overlap within channels, they are not likely to overlap in all of the frequency sub-bands. Rather, the audio objects are usually overlapped with each other just in some frequency sub-bands. Those frequency sub-bands without overlapped audio objects are likely to belong to one audio object with a high confidence, and their frequency spectra can be reliably assigned to the audio object. To the contrary, for those frequency sub-bands in which audio objects are overlapped, source separation operations might be needed to further generate cleaner objects which will be discussed below. It should be noted in some alternative embodiments, subsequent operations can be performed directly on the full frequency band. In such embodiments, step S202 may be omitted.

The method 200 then proceeds to step S203 to apply framing operations on the blocks such that a predefined number of blocks are combined to form a frame. It would be appreciated that audio objects could have a high dynamic range of duration, which could be from several milliseconds to a dozen seconds. By performing the framing operation, it is possible to extract the audio objects with a variety of durations. In some embodiments, the duration of a frame may be set to no more than the minimum duration of audio objects to be extracted (e.g., thirty milliseconds). Outputs of step S203 are temporal-spectral tiles each of which is a spectral representation within a frequency sub-band or the full frequency band of a frame.

Figure 3:
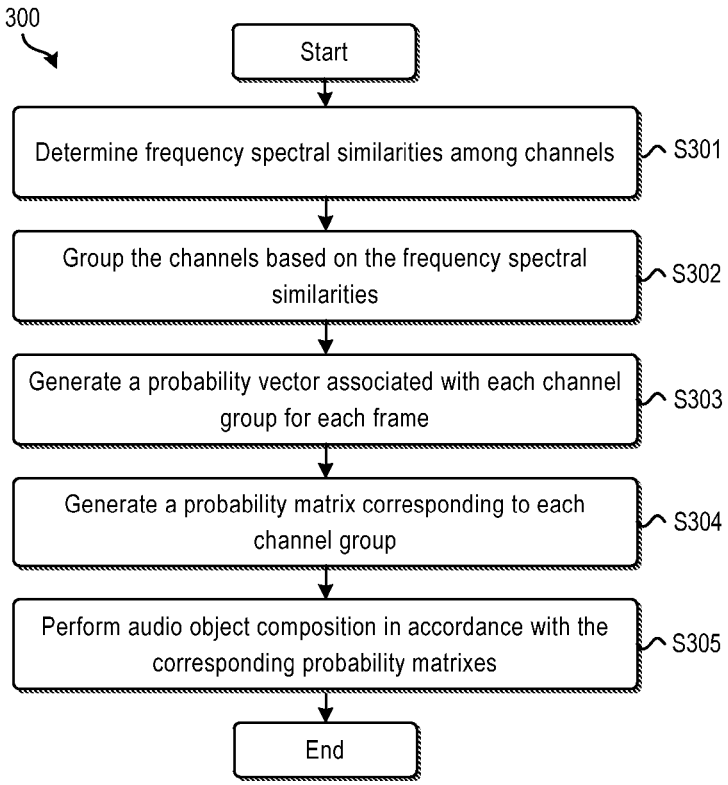
FIG. 3 illustrates a flowchart of flowchart of a method for audio object extraction in accordance with another example embodiment of the present invention.

FIG. 3 shows a flowchart of a method 300 for audio object extraction in accordance with some example embodiments of the present invention. The method 300 may be considered as a specific implementation of the method 100 as describe above with reference to FIG. 1.

In the method 300, the frame-level audio object extraction is performed through steps S301 to S303. Specifically, at step S301, for each of the multiple or all frames of the audio content, the frequency spectral similarities between every two channels of the input audio content are determined, thereby obtaining a set of frequency spectral similarities. To measure the similarity of a pair of channels, for example, on a sub-band basis, it is possible to utilize at least one of the frequency spectral envelops and frequency spectral shapes. The frequency spectral envelops and shapes are two types of complementary frequency spectral similarity measurements at frame level. The frequency spectral shape may reflect the frequency spectral properties in the frequency direction, while the frequency spectral envelop may describe the dynamic property of each frequency sub-band in the temporal direction.

More specifically, a temporal-spectral tile of a frame for the bth frequency sub-band of the cth channel may be denoted as $X_{(b)}^{(c)}(m, n)$, where m and n represent the block index in the frame and the frequency bin index in the bth frequency sub-band, respectively. In some embodiments, the similarity of frequency spectral envelops between two channels may be defined as:

$$S_{(b)}^{E}(i, j) = \frac{\sum_{m} \tilde{X}_{(b)}^{(i)}(m)\tilde{X}_{(b)}^{(j)}(m)}{\sqrt{\sum_{m} \tilde{X}_{(b)}^{(i)}(m)^2}\sqrt{\sum_{m} \tilde{X}_{(b)}^{(j)}(m)^2}} \quad (1)$$

where $\tilde{X}_{(b)}^{(i)}$ represents the frequency spectral envelop over blocks and may be obtained as follows:

$$\tilde{X}_{(b)}^{(i)}(m) = \alpha \sum_{n \in B_{(b)}} X_{(b)}^{(i)}(m, n) \quad (2)$$

where the $B_{(b)}$ represents the set of frequency bin indexes within the bth frequency sub-band, and $\alpha$ represents a scaling factor. In some embodiments, the scaling factor $\alpha$ may be set to the inverse of the number of frequency bins within that frequency sub-band in order to obtain an average frequency spectrum, for example.

Alternatively or additionally, for the bth frequency sub-band, the similarity of frequency spectral shapes between two channels may be defined as:

$$S_{(b)}^{P}(i, j) = \frac{\sum_{n} \tilde{X}_{(b)}^{(i)}(n)\tilde{X}_{(b)}^{(j)}(n)}{\sqrt{\sum_{n} \tilde{X}_{(b)}^{(i)}(n)^2}\sqrt{\sum_{n} \tilde{X}_{(b)}^{(j)}(n)^2}} \quad (3)$$

where $\tilde{X}_{(b)}^{(i)}$ represents the frequency spectral shape over frequency bins and may be calculated as follows:

$$\tilde{X}_{(b)}^{(i)}(n) = \beta \sum_{m \in F_{(b)}} X_{(b)}^{(i)}(m, n) \quad (4)$$

where $F_{(b)}$ represents the set of block indexes within the frame, and $\beta$ represents another scaling factor. In some embodiments, the scaling factor $\beta$ may be set to the inverse of the number of blocks in the frame, for example, in order to obtain an average frequency spectral shape.

In accordance with embodiments of the present invention, similarities of the frequency spectral envelops and shapes may be used alone or in combination. When these two metrics are used in combination, they can be combined in various manners such as linear combination, weighted sum, or the like. For example, in some embodiments, the combined metric may be defined as follows:

$$S_{(b)} = \alpha \times S_{(b)}^{E} + (1-\alpha) \times S_{(b)}^{P}, \alpha \leq \alpha \leq 1 \quad (5)$$

Alternately, as described above, the full frequency band may be directly used in other embodiments. In such embodiments, it is possible to measure the full frequency band similarity of a pair of channels based on frequency sub-band similarities. As an example, for each frequency sub-band, the similarity of frequency spectral envelops and/or shapes may be calculated as discussed above. In one embodiment, there will be H resulting similarities, where H is the number of frequency sub-bands. Next, the H frequency sub-band similarities may be sorted in descending order. Then the mean value of top h ($h \leq H$) similarities may be calculated as the full frequency band similarity.

Continuing reference to FIG. 3, at step S302, the set of frequency spectral similarities obtained at step S301 are used to group the plurality of channels in order to obtain a set of channel groups, such that each of the channel groups is associated with at least one common audio object. In accordance with embodiments of the present invention, given the frequency spectral similarities among the channels, the grouping or clustering of channels may be done in a variety of manners. For example, in some embodiments, clustering algorithms such as partitioning methods, hierarchical methods, density-based methods, grid-based methods, and model-based methods can be used.

In some example embodiments, hierarchical clustering techniques may be used to group the channel. Specifically, for every individual frame, each of the plurality of channels may be initialized as a channel group, denoted as $C_T$, where T represents the total number of channels. That is, initially every channel group contains a signal channel. Then the channel groups may be iteratively clustered based on the intra-group frequency spectral similarity as well as the inter-group frequency spectral similarity. In accordance with embodiments of the present invention, the intra-group frequency spectral similarity may be calculated based on the frequency spectral similarities of every two channels within the given channel group. More specifically, in some embodiments, the intra-group frequency spectral similarity for each channel group may be determined as:

$$s_{intra}(m) = \frac{\sum_{i \in C_m} \sum_{j \in C_n} s_{ij}}{N_m} \quad (6)$$

where $S_{ij}$ represents the frequency spectral similarity between the ith and jth channels, and $N_m$ represents the number of channels within the mth channel group.

The inter-group frequency spectral similarity represents the frequency spectral similarity among different channel groups. In some embodiments, the inter-group frequency spectral similarity for the mth and nth channel groups may be determined as follows:

$$s_{inter}(m, n) = \frac{\sum_{i \in C_m} \sum_{j \in C_n} s_{ij}}{N_{mn}} \quad (7)$$

where $N_{mn}$ represents the number of channel pairs between the mth and nth channel groups.

Then, in some embodiments, a relative inter-group frequency spectral similarity for each pair of channel groups may be calculated, for example, by dividing the absolute inter-group frequency spectral similarity by the mean of two respective intra-group frequency spectral similarities:

$$s_{rela}(m, n) = \frac{s_{inter}(m, n)}{0.5 \times (s_{intra}(m) + s_{intra}(n))} \quad (8)$$

Then a pair of channel groups with a maximum relative inter-group frequency spectral similarity may be determined. If the maximum relative inter-group frequency spectral is less than a predefined threshold, then the grouping or clustering terminates. Otherwise, these two channel groups are merged as a new channel group, and the grouping is iteratively performed as discussed above. It should be noted that the relative inter-group frequency spectral similarity may be calculated in any alternative manners such as weighted mean of the inter-group and intra-group frequency spectral similarities, and the like.

It would be appreciated that with the above proposed hierarchical clustering procedure, there is no need to specify the number of target channel groups in advance, which may not be fixed over time and thus hard to set in practice. Rather, in some embodiments, the predefined threshold for the relative inter-group frequency spectral similarity is used. The predefined threshold can be interpreted as the minimum allowed relative frequency spectral similarity between channel groups, and can be set to a constant value over time. In this way, the number of resulting channel groups may be adaptively determined.

Specifically, in accordance with embodiments of the present invention, the grouping or clustering may output a hard decision about which channel group a channel belongs to with a probability of either one or zero. For contents such as stems or pre-dubs, the hard decision works well. As used herein, the term "stem" refers to the channel-based audio content prior to being combined with other stems to produce a final mix. Examples of such a type of content comprise dialogue stems, sound effect stems, music stems, and the forth. The term "pre-dub" refers to the channel-based audio content prior to being combined with other pre-dubs to produce a stem. For these kinds of audio content, there are few cases in which audio objects are overlapped within channels, and the probability of a channel belonging to a group is deterministic.

However, for more complex audio contents such as final mixes, there may be multiple audio objects that mix with each other within some channels. These channels could belong to more than one channel group. To this end, in some embodiments, a soft decision may be adopted in channel grouping. For example, in some embodiments, for each frequency sub-band or the full frequency band, we assume that $C_1, \ldots, C_M$ represent the resulting channel groups of the clustering, and $|C_m|$ represents the number of channels within the mth channel group. The probability of the ith channel belonging to the mth channel group may be calculated as follows:

$$p_i^m = \frac{\frac{1}{N_i^m}\sum_{j\in C_m} s_{ij}}{\sum_m \frac{1}{N_i^m}\sum_{j\in C_m} s_{ij}} \tag{9}$$

wherein $N_i^m=|C_m|-1$ if the ith channel belongs to the mth channel group; otherwise, $N_i^m=|C_m|$. In this way, the probability $p_i^m$ may be defined as the normalized frequency spectral similarity between a channel and a channel group. The probability of each sub-band or the full-band belonging to a channel group may be determined as:

$$p^m = \frac{1}{|C_m|}\sum_{i\in C_m} p_i^m \tag{10}$$

The soft decision can provide more information than a hard decision. For example, we consider an example where one audio object appears in the left (L) and central (C) channels while another audio object appears in central (C) and right (R) channels, with overlapping in the central channel. If a hard decision is used, three groups {L}, {C} and {R} could be formed without indicating the fact that the central channel contains two audio objects. With a soft decision, the probability of the central channel belonging to either the group {L} or {R} can be used as an indicator indicating that the central channel contains audio objects from the left and right channels. Another benefit of using the soft decision is that the soft decision values can be fully utilized by the subsequent source separation to perform better separation of audio objects, which will be detailed later.

Specifically, in some embodiments, for a silent frame whose energy is below a predefined threshold in all input channels, no grouping operation is applied. It means that no channel groups will be generated for such a frame.

As shown in FIG. 3, at step S303, for each frame of the audio content, a probability vector may be generated in association with each of the set of channel groups obtained at step S302. A probability vector indicates the probability value that each sub-band or the full frequency band of a given frame belongs to the associated channel group. For example, in those embodiments where frequency sub-bands are considered, the dimension of a probability vector is the same as the number of frequency sub-bands, and the kth entry represents the probability value that the kth frequency sub-band tile (i.e., the kth temporal-spectral tile of a frame) belongs to that channel group.

As an example, the full frequency band is assumed to be divided into K frequency sub-bands for a five-channel input with the channel configuration of L, R, C, Ls and Rs channels. There are totally $2^5-1=31$ probability vectors, each of which is a K-dimensional vector associated with a channel group. For the kth frequency sub-band tile, if three channel groups {L, R}, {C} and {Ls, Rs} are obtained by the channel grouping process, for example, then the kth entry of each of these three K-dimensional probability vectors is filled with the corresponding probability value. Specifically, in accordance with embodiments of the present invention, the probability value may be a hard decision value of either one or zero, or a soft decision value ranging from zero to one. For each of the probability vectors associated with the remaining channel groups, the kth entry is set to zero.

Figure 4:
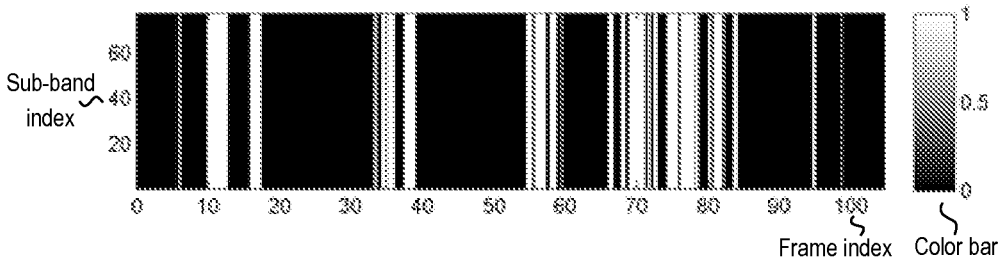
FIG. 4 illustrates a schematic diagram of example probability matrix of a channel group in accordance with an example embodiment of the present invention.

The method 300 proceeds to steps S304 and S305, where audio object composition across the frames is carried out. At step S304, a probability matrix corresponding to each of the channel groups is generated by concentrating the associated probability vectors across the frames. An example of the probability matrix of a channel group is shown in FIG. 4, where the horizontal axis represents the indexes of frames and the vertical axis represents the indexes of frequency sub-bands. It can be seen that in the shown example, each of the probability values within the probability vector/matrix is a hard probability value of either one or zero.

It would be appreciated that the probability matrix of a channel group generated at step S304 may well describe a complete, stationary audio object in that channel group. However, as mentioned above, a real audio object may move around, so that it may transit from one channel group to another. Hence, at step S305, audio object composition among the channel groups is carried out across the frames in accordance with the corresponding probability matrixes, thereby obtaining a complete audio object. In accordance with embodiments of the present invention, the audio object composition is performed across all the available channel groups frame by frame to generate a set of probability matrixes representing a complete object track, where each of the probability matrixes is corresponding to a channel within that object track.

In accordance with embodiments of the present invention, the audio object composition may be done by concatenating the probability vectors of the same audio object in different channel groups frame by frame. In doing so, several spatial and frequency spectral cues or rules can be used either alone or in combination. For example, in some embodiments, the continuity of probability values over the frames may be taken into account. In this way, it is possible to identify an audio object as complete as possible in a channel group. For a channel group, if the probability values greater than a predefined threshold show continuity over multiple frames, these multi-frame probability values could belong to the same object and are used together to compose the probability matrixes of an object track. For the sake of discussion, this rule may be referred as "Rule-C."

Alternatively or additionally, the number of shared channels among the channel groups may be used to track the audio object (referred as "Rule-N"), in order to identify a channel group(s) into which a moving audio object could enter. When an audio object moves from one channel group to another, a subsequent channel group needs to be determined and selected to form the complete audio object. In some embodiments, the channel group(s) with the maximum number of shared channels with the previous-selected channel group may be an optimal candidate, since such channel group(s) has the highest probability that the audio object could move into.

Besides the cue of shared channels (Rule-N), another effective cue for composing a moving audio object is the frequency spectral cue measuring frequency spectral similarity of two or more consecutive frames across different channel groups (referred as "Rule-S"). It is found that when an audio object moves from one channel group to another between two consecutive frames, its frequency spectrum generally shows high similarity between these two frames. Hence, the channel group showing a maximum frequency spectral similarity with the previous-selected channel group may be selected as an optimal candidate. Rule-S is useful to identify a channel group into which a moving audio object enters. The frequency spectrum of the fth frame for the gth channel group may be denoted as $X_{[f]}^{[g]}(m,n)$, where m and n represent the block index in the frame and the frequency bin index within a frequency band (it could be either a full frequency band or a frequency sub-band), respectively. In some embodiments, the frequency spectral similarity between the frequency spectrum of the fth frame for the ith channel group and that of the (f−1)th frame for the jth channel group may be determined as follows:

$$S_{[f,f-1]}(i,j) = \frac{\sum_n \tilde{X}_{[f]}^{[i]}(n)\tilde{X}_{[f-1]}^{[j]}(n)}{\sqrt{\sum_n \tilde{X}_{[f]}^{[i]}(n)^2}\sqrt{\sum_n \tilde{X}_{[f-1]}^{[j]}(n)^2}} \tag{11}$$

where $\tilde{X}_{[f]}^{[i]}$ represents the frequency spectral shape over frequency bins. In some embodiments, it may be calculated as:

$$\tilde{X}_{[f]}^{[i]}(n) = \lambda \sum_{m \in F_{[f]}} X_{[f]}^{[i]}(m,n) \tag{12}$$

where $F_{[f]}$ represents the set of block indexes within the fth frame, and λ represents a scaling factor.

Alternatively or additionally, energy or loudness associated with the channel groups may be used in audio object composition. In such embodiments, the dominant channel group with the largest energy or loudness may be selected in the composition, which may be referred as "Rule-E". This rule may be applied, for example, on the first frame of the audio content or for the frame after a silent frame (a frame in which the energies of all input channels are less than a predefined threshold). In order to represent the dominance of a channel group, in accordance with embodiments of the present invention, the maximum, minimum, mean or median energy/loudness of the channels within the channel group can be used as a metric.

It is also possible to only consider the probability vectors that have not been used before when composing a new audio object (referred as "Rule-Not-Used"). When more than one multichannel object track needs to be generated and the probability vectors filled with either ones or zeros are used to generate the frequency spectra of an audio object track, this rule may be used. In such embodiments, the probability vectors that have been used in composition of a previous audio object will not be used in the subsequent audio object composition.

In some embodiments, these rules may be combined to compose the audio objects among the channel groups across the frames. For example, in an example embodiment, if there is no channel group selected in the previous frame, e.g., at the first frame of the audio content or the frame after a silent frame, the Rule-E may be used and then the next frame will be processed. Otherwise, if the probability values stay high in current frame for the previously selected channel group, Rule-C may be applied; otherwise, the Rule-N may be used to find a set of channel groups with a maximum number of shared channels with the one selected in the previous frame. Next, Rule-S may be applied to choose a channel group from the resultant set of the previous step. If the maximum similarity is greater than a predefined threshold, the selected channel group may be used; otherwise, Rule-E may be used. Furthermore, in those embodiments where there are multiple audio objects to be extracted with the probability values of either ones or zeros, Rule-Not-Used may be involved in some or all steps described above, in order to prevent from re-using the probability vectors already assigned to another object track. It should be noted the rules or cues and the combination thereof as discussed above are just for the purpose of illustration, without limiting the scope of the present invention.

Figure 5:
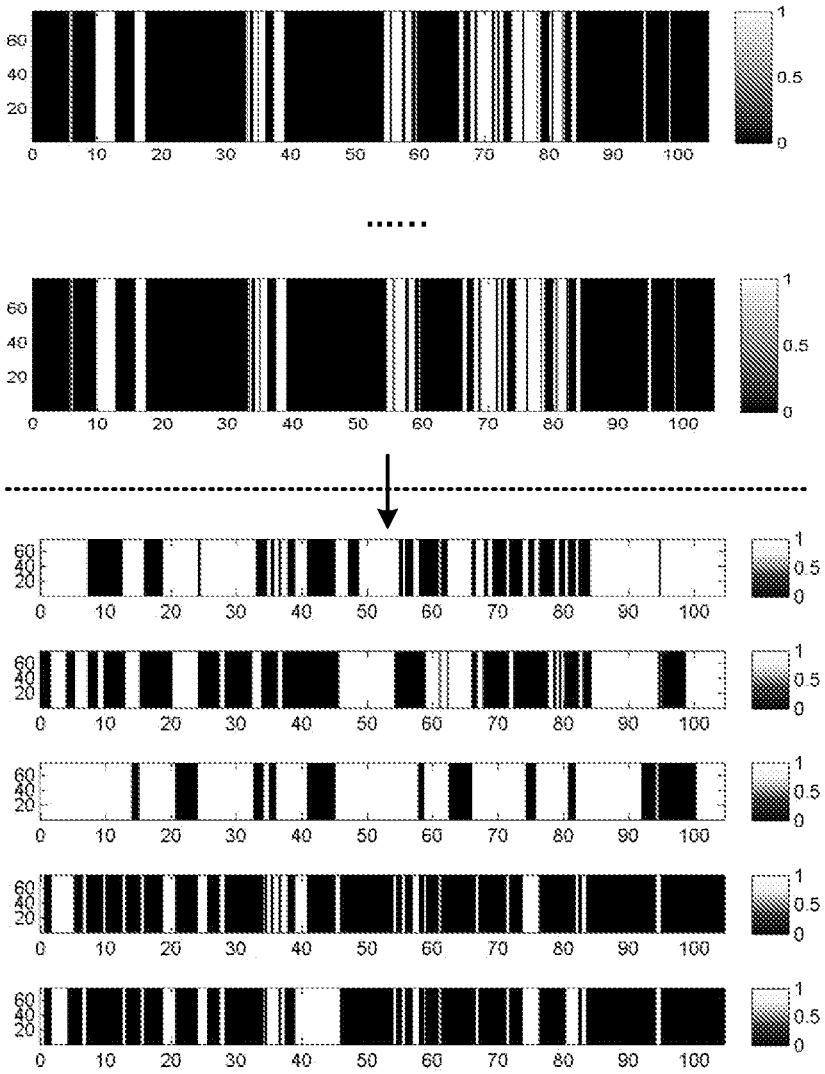
FIG. 5 illustrates schematic diagrams of example probability matrixes of a composed complete audio object for a five-channel input audio content in accordance with example embodiments of the present invention.

By using these cues, the probability matrixes from the channel groups may be selected and composed to obtain the probability matrixes of the extracted multichannel object track, thereby achieving the audio object composition. As an example, FIG. 5 shows example probability matrixes of a complete multichannel audio object for a five-channel input audio content with the channel configuration of {L, R, C, Ls, Rs}. The top portion shows the probability matrixes of all available channel groups ($2^5-1=31$ channel groups in this case). The bottom portion shows the probability matrixes of the generated multichannel object track, including the probability matrixes respectively for L, R, C, Ls and Rs channels.

It should be noted that there may be multiple probability matrixes generated from the above process for a multichannel object track, and each probability matrix corresponds to a channel, as shown in the right part of FIG. 5. For each frame of the generated audio object track, in some embodiments, the probability vector of the selected channel group may be copied into the corresponding channel-specific probability matrixes of the audio object track. For example, if a channel group of {L, R, C} is selected to generate the track of an audio object for a given frame, then the probability vector of the channel group may be duplicated to generate the probability vectors of the channels L, R and C of the audio object track for that given frame.

Figure 6:
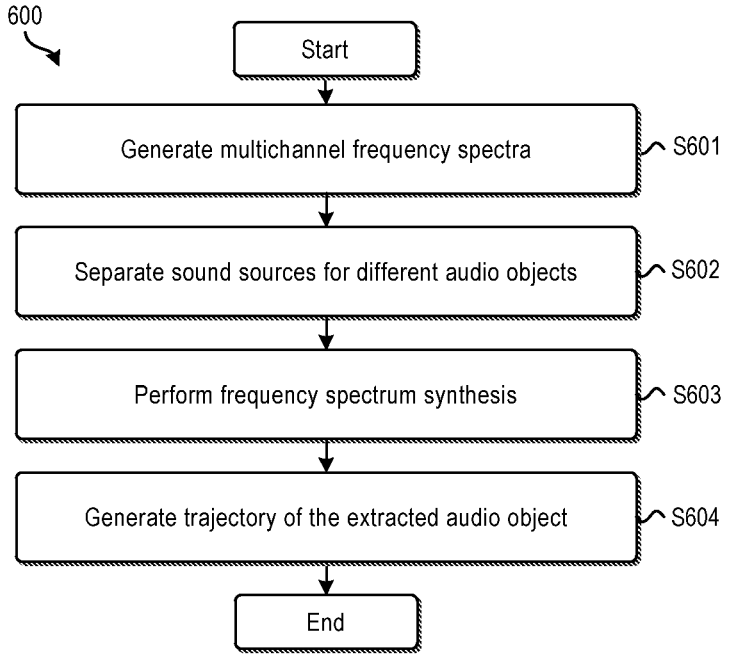
FIG. 6 illustrates a flowchart of a method for post-processing the extracted audio object in accordance with an example embodiment of the present invention.

Referring to FIG. 6, a flowchart of a method 600 for post-processing of the extracted audio object in accordance with embodiments of the present invention is shown. Embodiments of the method 600 may be used to process the resulting audio object(s) extracted by the methods 200 and/or 300 as discussed above.

At step S601, multichannel frequency spectra of the audio object track is generated. In some embodiments, for example, the multichannel frequency spectra may be generated based on the probability matrixes of that track as described above. For example, the multichannel frequency spectra may be determined as follows:

$$X_o = X_i \otimes P \tag{13}$$

where $X_i$ and $X_o$ represent the input and output frequency spectrum of a channel, respectively, and P represents the probability matrix associated with that channel.

Such simple, efficient method works well for stems or pre-dubs, since each temporal-spectral tile seldom contains mixed audio objects. However, for complex contents such as final mixes, it is observed that there are two or more audio objects that overlap with each other in the same temporal-spectral tiles. In order to address this problem, in some embodiments, the sound source separation is performed at step S602 to separate the spectra of different audio objects from the multichannel spectra, such that the mixed audio object tracks may be further separated into cleaner audio objects.

In accordance with embodiments of the present invention, at step S602, two or more mixed audio objects may be separated by applying statistical analysis on the generated multichannel frequency spectra. For example, in some embodiments, eigenvalue decomposition techniques can be used to separate sound sources, including but not limited to principal component analysis (PCA), independent component analysis (ICA), canonical component analysis (CCA), non-negative spectrogram factorization algorithms such as non-negative matrix factorization (NMF) and its probabilistic counterparts such as probabilistic latent component analysis (PLCA), and so forth. In these embodiments, uncorrelated sound sources may be separated by their eigenvectors. Dominance of sound sources are usually reflected by the distribution of eigenvalues, and the highest eigenvalue could correspond to the most dominant sound source.

As an example, the multichannel frequency spectra of a frame may be denoted as $X^{(i)}(m, n)$, where i represents the channel index, and the m and n represent the block index and frequency bin index, respectively. For a frequency bin, a set of frequency spectrum vectors, denoted as $[X^{(1)}(m,n), \ldots, X^{(T)}(m,n)]$, $1 \le m \le M$ (M is the number of blocks of a frame), may be formed. Then PCA may be applied onto these vectors to obtain the corresponding eigenvalues and eigenvectors. In this way, the dominance of sound sources may be represented by their eigenvalues.

Specifically, in some embodiments, the sound source separation may be done with reference to the result of the audio object composition across the frames. In these embodiments, the probability vectors/matrixes of the extracted audio object tracks, as discussed above, may be used to assist the eigenvalue decomposition for sound source separation. Moreover, for example, PCA may be used to determine a dominant source(s), while CCA may be used to determine a common source(s). As an example, if an audio object track has a highest probability within a set of channels for a temporal-spectral tile, it may indicate that frequency spectrum within the tile has high similarity across the channels within that set and has the highest confidence to belong to a dominant audio object less mixed by other audio objects. If the size of the channel set is larger than one, CCA may be applied onto the tile to filter noise (e.g., from other audio objects) and extract a cleaner audio object. On the other hand, if an audio object track has a lower probability within a set of channels for a temporal-spectral tile, it indicates that more than one audio object may exist within the set of channels. If more than one channel is within the channel set, PCA can be applied onto the tile to separate different sources.

The method 600 then proceeds to step S603 for frequency spectrum synthesis. In the outputs from the source separation or audio object extraction, signals are presented in a multichannel format in the frequency domain. With the frequency spectrum synthesis at step S603, the track of the extracted audio object may be formatted as desired. For example, it is possible to convert the multichannel tracks into a waveform format or down-mix a multichannel track into a stereo/mono audio track with energy preservation.

For example, multichannel frequency spectra may be denoted as $X^{(i)}(m,n)$, where i represents the channel index, and the m and n represent the block index and frequency bin index, respectively. In some embodiments, the down-mixed mono frequency spectrum may be calculated as follows:

$$X_{mono} = \sum_i X^{(i)}(m, n) \tag{14}$$

In some embodiments, in order to preserve the energy of the mono audio signal, an energy-preserving factor $\alpha_m$ may be taken into account. Accordingly, the down-mixed mono frequency spectrum becomes:

$$X_{mono} = \alpha_m \sum_i X^{(i)}(m, n) \tag{15}$$

In some embodiments, for example, the factor $\alpha_m$ may satisfy the following equations $$\alpha_m^2 \sum_n \left\| \sum_i X^{(i)}(m, n) \right\|^2 = \sum_i \sum_n \| X^{(i)}(m, n) \|^2 \tag{16}$$

where the operator $\| \ \|$ represents the absolute value of a frequency spectrum. The right side of the above equation represents the total energy of multichannel signals, while the left side except $\alpha_m^2$ represents the energy of down-mixed mono signals. In some embodiments, the factor $\alpha_m$ may be smoothed to avoid the modulation noise, for example, by:

$$\tilde{\alpha}_m = \beta\alpha_m + (1-\beta)\tilde{\alpha}_{m-1} \tag{17}$$

In some embodiments, β may be set to a fixed value less than one. The factor β is set to one only when $\alpha_m/\tilde{\alpha}_{m-1}$ is greater than a predefined threshold, which indicates that an attack signal appears. In those embodiments, the output mono signal may be weighted with $\tilde{\alpha}_m$:

$$X_{mono} = \tilde{\alpha}_m \sum_i X^{(i)}(m, n) \tag{18}$$

The final audio object track in a waveform (PCM) format can be generated by the synthesis techniques such as inverse FFT or CQMF synthesis.

Alternatively or additionally, at step S604, a trajectory of the extracted audio object(s) may be generated, as shown in FIG. 6. In accordance with embodiments of the present invention, the trajectory may be generated at least partially based on the configuration for the plurality of channels of the input audio content. As known, for the traditional channel-based audio content, the channel positions are usually defined with positions of their physical speakers. For example, for a five-channel input, the positions of speakers {L, R, C, Ls, Rs} is respectively defined with their angles such as {−30°, 30°, 0°, −110°, 110}. Given the channel configuration and the extracted audio objects, trajectory generation may be done by estimating the positions of the audio objects over time.

More specifically, if the channel configuration is given in term of an angle vector $\alpha=[\alpha_1, \ldots, \alpha_T]$ where T represents the number of channel, the position vector of a channel may be represented as a two-dimensional vector:

$$p^{(i)} \stackrel{def}{=} [p_1^{(i)}, p_2^{(i)}] = [\cos\alpha_i, \sin\alpha_i] \tag{19}$$

For each frame, the energy $E_i$ of the ith channel may be calculated. The target position vector of the extracted audio object may be calculated as follows:

$$p \stackrel{def}{=} [p_1, p_2] = \sum_{i=1}^{T} E_i \times p^{(i)} \tag{20}$$

The angle β of the audio object in the horizontal plane may be estimated by:

$$\cos\beta = \frac{p_1}{\sqrt{p_1^2 + p_2^2}}, \quad \sin\beta = \frac{p_2}{\sqrt{p_1^2 + p_2^2}} \tag{21}$$

After the angles of the audio object are available, its position can be estimated depending on the shapes of a space in which it is located. For example, for a circle room, the target position is calculated as [R×cos β, R×sin β], where R represents the radius of the circle room.

Figure 7:
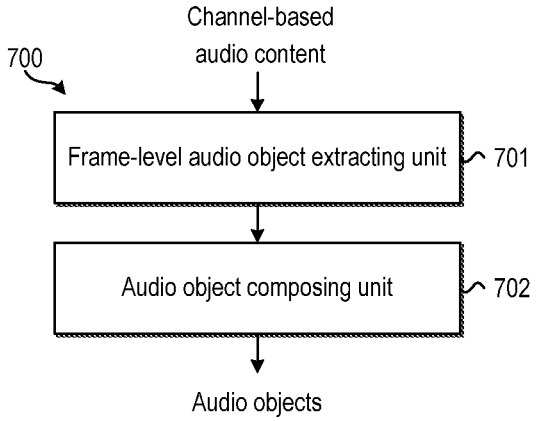
FIG. 7 illustrates a block diagram of a system for audio object extraction in accordance with an example embodiment of the present invention.

FIG. 7 shows a block diagram of a system 700 for audio object extraction in accordance with one example embodiment of the present invention is shown. As shown, the system 700 comprises a frame-level audio object extracting unit 701 configured to apply audio object extraction on individual frames of the audio content at least partially based on frequency spectral similarities among the plurality of channels. The system 700 also comprises an audio object composing unit 702 configured to perform audio object composition across the frames of the audio content, based on the audio object extraction on the individual frames, to generate a track of at least one audio object.

In some embodiments, the frame-level audio object extracting unit 701 may comprise a frequency spectral similarity determining unit configured to determine a frequency spectral similarity between every two of the plurality of channels to obtain a set of frequency spectral similarities; and a channel grouping unit configured to group the plurality of channels based on the set of frequency spectral similarities to obtain a set of channel groups, channels within each of the channel groups being associated with a common audio object.

In these embodiments, the channel grouping unit 702 may comprises a group initializing unit configured to initialize each of the plurality of channels as a channel group; an intra-group similarity calculating unit configured to calculate, for each of the channel groups, an intra-group frequency spectral similarity based on the set of frequency spectral similarities; and an inter-group similarity calculating unit configured to calculate an inter-group frequency spectral similarity for every two of the channel groups based on the set of frequency spectral similarities. Accordingly, the channel grouping unit 702 may be configured to iteratively cluster the channel groups based on the intra-group and inter-group frequency spectral similarities.

In some embodiments, the frame-level audio object extracting unit 701 may comprise a probability vector generating unit configured to generate, for each of the frames, a probability vector associated with each of the channel groups, the probability vector indicating a probability value that a full frequency band or a frequency sub-band of that frame belongs to the associated channel group. In these embodiments, the audio object composing unit 702 may comprise a probability matrix generating unit configured to generate a probability matrix from each of the channel groups by concentrating the associated probability vectors across the frames. Accordingly, the audio object composing unit 702 may be configured to perform the audio object composition among the channel groups across the frames in accordance with the corresponding probability matrixes.

Furthermore, in some embodiments, the audio object composition among the channel groups is performed based on at least one of: continuity of the probability values over the frames; a number of shared channels among the channel groups; a frequency spectral similarity of consecutive frames across the channel groups; energy or loudness associated with the channel groups; and determination whether one or more probability vectors have been used in composition of a previous audio object.

In addition, in some embodiments, the frequency spectral similarities among the plurality of channels are determined based on at least one of: similarities of frequency spectral envelops of the plurality of channels; and similarities of frequency spectral shapes of the plurality of channels.

In some embodiments, the track of the at least one audio object is generated in a multichannel format. In these embodiments, the system 700 may further comprise a multichannel frequency spectra generating unit configured to generate multichannel frequency spectra of the track of the at least one audio object. In some embodiments, the system 700 may further comprise a source separating unit configured to separate sources for two or more audio objects of the at least one audio object by applying statistical analysis on the generated multichannel frequency spectra. Specifically, the statistical analysis may be applied with reference to the audio object composition across the frames of the audio content.

Further, in some embodiments, the system 700 may further comprise a frequency spectrum synthesizing unit configured to perform frequency spectrum synthesis to generate the track of the at least one audio object in a desired format, including downmixing to stereo/mono and/or generating waveform signals, for example. Alternatively or additionally, the system 700 may comprise a trajectory generating unit configured to generate a trajectory of the at least one audio object at least partially based on a configuration for the plurality of channels.

For the sake of clarity, some optional components of the system 700 are not shown in FIG. 7. However, it should be appreciated that the features as described above with reference to FIGS. 1-6 are all applicable to the system 700. Moreover, the components of the system 700 may be a hardware module or a software unit module. For example, in some embodiments, the system 700 may be implemented partially or completely with software and/or firmware, for example, implemented as a computer program product embodied in a computer readable medium. Alternatively or additionally, the system 700 may be implemented partially or completely based on hardware, for example, as an integrated circuit (IC), an application-specific integrated circuit (ASIC), a system on chip (SOC), a field programmable gate array (FPGA), and so forth. The scope of the present invention is not limited in this regard.

Figure 8:
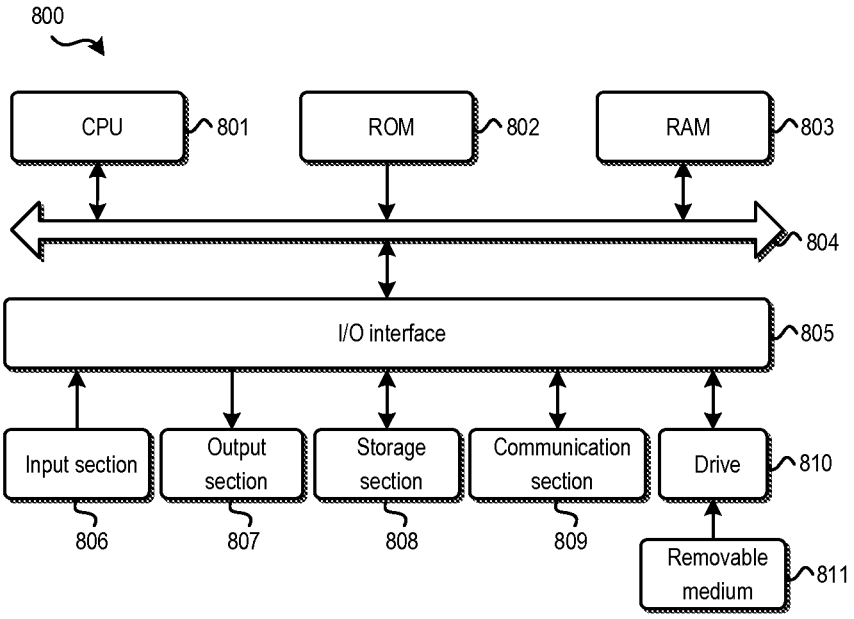
FIG. 8 illustrates a block diagram of an example computer system suitable for implementing embodiments of the present invention.

FIG. 8 shows a block diagram of an example computer system 800 suitable for implementing embodiments of the present invention. As shown, the computer system 800 comprises a central processing unit (CPU) 801 which is capable of performing various processes in accordance with a program stored in a read only memory (ROM) 802 or a program loaded from a storage section 808 to a random access memory (RAM) 803. In the RAM 803, data required when the CPU 801 performs the various processes or the like is also stored as required. The CPU 801, the ROM 802 and the RAM 803 are connected to one another via a bus 804. An input/output (I/O) interface 805 is also connected to the bus 804.

The following components are connected to the I/O interface 805: an input section 806 including a keyboard, a mouse, or the like; an output section 807 including a display such as a cathode ray tube (CRT), a liquid crystal display (LCD), or the like, and a loudspeaker or the like; the storage section 808 including a hard disk or the like; and a communication section 809 including a network interface card such as a LAN card, a modem, or the like. The communication section 809 performs a communication process via the network such as the internet. A drive 810 is also connected to the I/O interface 805 as required. A removable medium 811, such as a magnetic disk, an optical disk, a magneto-optical disk, a semiconductor memory, or the like, is mounted on the drive 810 as required, so that a computer program read therefrom is installed into the storage section 808 as required.

Specifically, in accordance with embodiments of the present invention, the processes described above with reference to FIGS. 1-6 may be implemented as computer software programs. For example, embodiments of the present invention comprise a computer program product including a computer program tangibly embodied on a machine readable medium, the computer program including program code for performing methods 200, 300 and/or 600. In such embodiments, the computer program may be downloaded and mounted from the network via the communication section 809, and/or installed from the removable medium 811.

Generally speaking, various example embodiments of the present invention may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments of the present invention are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, embodiments of the present invention include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include but not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other embodiments of the inventions set forth herein will come to mind to one skilled in the art to which these embodiments of the invention pertain having the benefit of the teachings presented in the foregoing descriptions and the drawings.

Accordingly, the present invention may be embodied in any of the forms described herein. For example, the following enumerated example embodiments (EEEs) describe some structures, features, and functionalities of some aspects of the present invention.

EEE 1. A method to extract objects from multichannel contents, comprising: frame-level object extraction for extracting objects on a frame basis; and object composition for using the outputs of frame-level object extraction and compose complete objects tracks over frames.

EEE 2. The method according to EEE 1, wherein the frame-level object extraction extracts objects on a frame basis, comprising calculating the channel-wise similarity matrix; and channel grouping by clustering based on the similarity matrix.

EEE 3. The method according to EEE 2, wherein the channel-wise similarity matrix is calculated either on a sub-band basis or on a full-band basis.

EEE 4. The method according to EEE 3, on a sub-band basis, the channel-wise similarity matrix is calculated based on any of the followings: spectral envelop similarity score defined by equation (1); spectral shape similarity score defined by equation (3); and fusion of the spectral envelop and spectral shape scores.

EEE 5. The method according to EEE 4, wherein the fusion of spectral envelop and spectral shape scores is achieved by the linear combination.

EEE 6. The method according to EEE 3, on a full-band basis, the channel-wise similarity matrix is calculated based on the procedure disclosed herein.

EEE 7. The method according to EEE 2, wherein the clustering technology includes the hierarchical clustering procedure discussed herein.

EEE 8. The method according to EEE 7, the relative inter-group similarity score defined by the equation (8) is used in the clustering procedure.

EEE 9. The method according to EEE 2, the clustering results of a frame are represented in form of a probability vector for each channel group, and an entry of the probability vector is represented with either of followings: a hard decision value of either zero or one; and a soft decision value ranging from zero to one.

EEE 10. The method according to EEE 9, the procedure of converting a hard decision to a soft decision as defined in equations (9) and (10) is used.

EEE 11. The method according to EEE 9, a probability matrix is generated for each channel group by assembling probability vectors of the channel group frame by frame.

EEE 12. The method according to EEE 1, the object composition uses the probability matrixes of all channel groups to compose the probability matrixes of an object track, wherein each of the probability matrixes of the object track corresponds to a channel within that particular object track.

EEE 13. The method according to EEE 12, the probability matrixes of an object track are composed by using the probability matrixes from all channel groups, based on any one of the following cues: the continuity of the probability values within a probability matrix (Rule-C); the number of shared channels (Rule-N); the similarity score of frequency spectrum (Rule-S); the energy or loudness information (Rule-E); and the probability values never used in the previously-generated object tracks (Rule-Not-Used).

EEE 14. The method according to EEE 13, these cues can be used jointly, as shown in the procedure disclosed herein.

EEE 15. The method according to any of EEEs 1-14, the object composition further comprises the spectrum generation for an object track, where the spectrum of a channel for an object track is generated by the original input channel spectrum and the probability matrix of the channel via a point-multiplication.

EEE 16. The method according to EEE 15, the spectra of an object track can be generated in either a multichannel format or a down-mixed stereo/mono format.

EEE 17. The method according to any of EEEs 1-16, further comprising source separation to generate cleaner objects using the outputs of object composition.

EEE 18. The method according to EEE 17, wherein the source separation uses eigenvalue decomposition methods, comprising either of followings: principal component analysis (PCA) that uses the distribution of eigenvalues to determine the dominant sources; canonical component analysis (CCA) that uses the distribution of eigenvalues to determine the common sources.

EEE19. The method according to EEE 17, the source separation is steered by the probability matrixes of an object track.

EEE 20. The method according to EEE 18, the lower probability value of an object track for a temporal-spectral tile indicates more than one source existing within the tile.

EEE 21. The method according to EEE 18, the highest probability value of an object track for a temporal-spectral tile indicates a dominant source existing within the tile.

EEE 22. The method according to any of EEEs 1-21, further comprising trajectory estimations for audio objects.

EEE 23. The method according to any of EEEs 1-22, further comprising: performing frequency spectrum synthesis to generate the track of the at least one audio object in a desired format, including downmixing the track to stereo/mono and/or generating waveform signals.

EEE 24. A system for audio object extraction, comprising units configured to carry out the respective steps of the method according to any of EEEs 1-23.

EEE 25. A computer program product for audio object extraction, the computer program product being tangibly stored on a non-transient computer-readable medium and comprising machine executable instructions which, when executed, cause the machine to perform steps of the method according to any of EEEs 1 to 23.

It will be appreciated that the embodiments of the invention are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method for audio object extraction from audio content, the audio content being of a format based on a plurality of channels, the method comprising:

applying audio object extraction on individual frames of the audio content at least partially based on frequency spectral similarities among the plurality of channels; and performing audio object composition across the frames of the audio content, based on the audio object extraction on the individual frames, to generate a track of at least one audio object, wherein applying audio object extraction on individual frames comprises grouping the plurality of channels based on the frequency spectral similarities among the plurality of channels to obtain a set of channel groups, channels within each of the channel groups being associated with at least one common audio object.

2. The method according to claim 1, wherein applying audio object extraction on individual frames comprises:

determining a frequency spectral similarity between every two of the plurality of channels to obtain a set of frequency spectral similarities; and wherein grouping the plurality of channels is performed based on the set of frequency spectral similarities.

3. The method according to claim 2, wherein grouping the plurality of channels based on the set of frequency spectral similarities comprises:

initializing each of the plurality of channels as a channel group;

calculating, for each of the channel groups, an intra-group frequency spectral similarity based on the set of frequency spectral similarities;

calculating an inter-group frequency spectral similarity for every two of the channel groups based on the set of frequency spectral similarities; and iteratively clustering the channel groups based on the intra-group and inter-group frequency spectral similarities.

4. The method according to claim 2, wherein applying audio object extraction on individual frames comprises:

generating, for each of the frames, a probability vector associated with each of the channel groups, the probability vector indicating a probability value that a full frequency band or a frequency sub-band of that frame belongs to the associated channel group.

5. The method according to claim 4, wherein performing audio object composition comprises:

generating a probability matrix corresponding to each of the channel groups by concentrating the associated probability vectors across the frames; and performing the audio object composition among the channel groups across the frames in accordance with the corresponding probability matrixes.

6. The method according to claim 5, wherein the audio object composition among the channel groups is performed based on at least one of:

continuity of the probability values over the frames;

a number of shared channels among the channel groups;

a frequency spectral similarity of consecutive frames across the channel groups;

energy or loudness associated with the channel groups; and a determination whether a probability vector has been used in composition of a previous audio object.

7. The method according to claim 1, wherein the frequency spectral similarities among the plurality of channels are determined based on at least one of:

similarities of frequency spectral envelops of the plurality of channels; and similarities of frequency spectral shapes of the plurality of channels.

8. The method according to claim 1, wherein the track of the at least one audio object is generated in a multichannel format, the method further comprising:

generating multichannel frequency spectra of the track of the at least one audio object.

9. The method according to claim 8, further comprising:

separating sources for two or more audio objects of the at least one audio object by applying statistical analysis on the generated multichannel frequency spectra.

10. The method according to claim 9, wherein the statistical analysis is applied with reference to the audio object composition across the frames of the audio content.

11. The method according to claim 1, further comprising at least one of:

performing frequency spectrum synthesis to generate the track of the at least one audio object in a desired format; and generating a trajectory of the at least one audio object at least partially based on a configuration for the plurality of channels.

12. A system for audio object extraction from audio content, the audio content being of a format based on a plurality of channels, the system comprising:

a frame-level audio object extracting unit configured to apply audio object extraction on individual frames of the audio content at least partially based on frequency spectral similarities among the plurality of channels; and an audio object composing unit configured to perform audio object composition across the frames of the audio content, based on the audio object extraction on the individual frames, to generate a track of at least one audio object, wherein the frame-level audio object extracting unit comprises a channel grouping unit configured to group the plurality of channels based on frequency spectral similarities among the plurality of channels to obtain a set of channel groups, channels within each of the channel groups being associated with at least one common audio object.

13. The system according to claim 12, wherein the frame-level audio object extracting unit comprises:

a frequency spectral similarity determining unit configured to determine a frequency spectral similarity between every two of the plurality of channels to obtain a set of frequency spectral similarities; and wherein the channel grouping unit is configured to group the plurality of channels based on the set of frequency spectral similarities.

14. The system according to claim 13, wherein the channel grouping unit comprises:

a group initializing unit configured to initialize each of the plurality of channels as a channel group;

an intra-group similarity calculating unit configured to calculate, for each of the channel groups, an intra-group frequency spectral similarity based on the set of frequency spectral similarities; and an inter-group similarity calculating unit configured to calculate an inter-group frequency spectral similarity for every two of the channel groups based on the set of frequency spectral similarities, wherein the channel grouping unit is configured to iteratively cluster the channel groups based on the intra-group and inter-group frequency spectral similarities.

15. The system according to claim 13, wherein the frame-level audio object extracting unit comprises:

a probability vector generating unit configured to generate, for each of the frames, a probability vector associated with each of the channel groups, the probability vector indicating a probability value that a full frequency band or a frequency sub-band of that frame belongs to the associated channel group.

16. The system according to claim 15, wherein the audio object composing unit comprises:

a probability matrix generating unit configured to generate a probability matrix corresponding to each of the channel groups by concentrating the associated probability vectors across the frames, wherein the audio object composing unit is configured to perform the audio object composition among the channel groups across the frames in accordance with the corresponding probability matrixes.

17. The system according to claim 16, wherein the audio object composition among the channel groups is performed based on at least one of:

continuity of the probability values over the frames;

a number of shared channels among the channel groups;

a frequency spectral similarity of consecutive frames across the channel groups;

energy or loudness associated with the channel groups; and a determination whether a probability vector has been used in composition of a previous audio object.

18. The system according to claim 12, wherein the frequency spectral similarities among the plurality of channels are determined based on at least one of:

similarities of frequency spectral envelops of the plurality of channels; and similarities of frequency spectral shapes of the plurality of channels.

19. The system according to claim 12, wherein the track of the at least one audio object is generated in a multichannel format, the system further comprising:

a multichannel frequency spectra generating unit configured to generate multichannel frequency spectra of the track of the at least one audio object.

20. The system according to claim 19, further comprising:

a source separating unit configured to separate sources for two or more audio objects of the at least one audio object by applying statistical analysis on the generated multichannel frequency spectra.

21. The system according to claim 20, wherein the statistical analysis is applied with reference to the audio object composition across the frames of the audio content.

22. The system according to claim 12, further comprising at least one of:

a frequency spectrum synthesizing unit configured to perform frequency spectrum synthesis to generate the track of the at least one audio object in a desired format; and a trajectory generating unit configured to generate a trajectory of the at least one audio object at least partially based on a configuration for the plurality of channels.

23. A computer program product for audio object extraction, the computer program product being tangibly stored on a non-transient computer-readable medium and comprising machine executable instructions which, when executed, cause the machine to perform steps of the method according to claim 1.

* * * * *